US005643024A

United States Patent [19]

Roberson, Jr.

[11] Patent Number: 5,643,024

[45] Date of Patent: Jul. 1, 1997

[54] ADAPTER PLATE

[76] Inventor: Harold Theodore Roberson, Jr., P.O. Box 974, Ft. Smith, Ark. 72902

[21] Appl. No.: 694,250

[22] Filed: Aug. 8, 1996

[51] Int. Cl.[6] ..... B63H 21/14

[52] U.S. Cl. ..... 440/76

[58] Field of Search ..... 440/76, 77, 78, 440/49, 88, 89, 900

[56] References Cited

U.S. PATENT DOCUMENTS

| | | | |
|---|---|---|---|
| 4,906,214 | 3/1990 | Towner | 440/76 |
| 5,105,334 | 4/1992 | Holinka | 440/76 |
| 5,487,687 | 1/1996 | Idzikowski et al. | 440/88 |

*Primary Examiner*—Stephen Avila

[57] ABSTRACT

An adapter plate to attach a four cycle internal combustion verticle shaft engine to an outboard motor lower drive unit creating a four cycle internal combustion engine outboard motor for powering small boats and crafts through the water.

1 Claim, 3 Drawing Sheets

ADAPTER PLATE

FIELD OF THE INVENTION

This invention relates to techniques and a device for the attachment of an four cycle internal combustion verticle shaft engine to an outboard motor lower unit.

More particularly this invention relates to a device used for the attaching of a four cycle verticle shaft internal combustion engine to an outboard motor lower drive unit.

BACKGROUND OF THE INVENTION

Standard outboard motors made in the 20 horsepower and under range have a problem in that they are two cycle and highly contaminate the water and air with oil. Purpose of this invention is to create an adapter wherein a four cycle verticle shaft internal combustion engine can be attached directly to a prexisting, manufactured, or constructed outboard lower drive unit thereby creating a four cycle outboard motor and drive unit.

SUMMARY OF THE PRESENT INVENTION

In accordance with the present invention there is provided an adapter plate which can be easily installed between a four cycle verticle shaft combustion engine and a lower drive unit from an outboard motor can be attached to the other side of the adapter plate thus attaching a four cycle internal combustion engine to a two cycle outboard motor lower drive unit. The adapter plate can be provided in different sizes and shapes in order to fit various manufacturers verticle shaft four cycle engines of varying horsepowers and sizes and to accomodate different size and shapes of outboard lower drive units produced by various manufacturers. In a preferred embodiment the adapter plate unit consists of a body member having a means of attachment to which an internal combustion engine can be attached to one side and on the opposite side of the appature plate a lower unit can be attached to the adapter plate. Through the center of the adapter plate is a hole that allows the crank shaft of the engine to be directly attached to the drive shaft of the lower unit. There are various recesses within the adapter plate, which are below the attaching surfaces of the engine, to allow for the clearances for the oil pan and oil pump on the various small verticle shaft internal combustion engines.

DETAILED DESCRIPTION OF THE INVENTION

Figure 1:
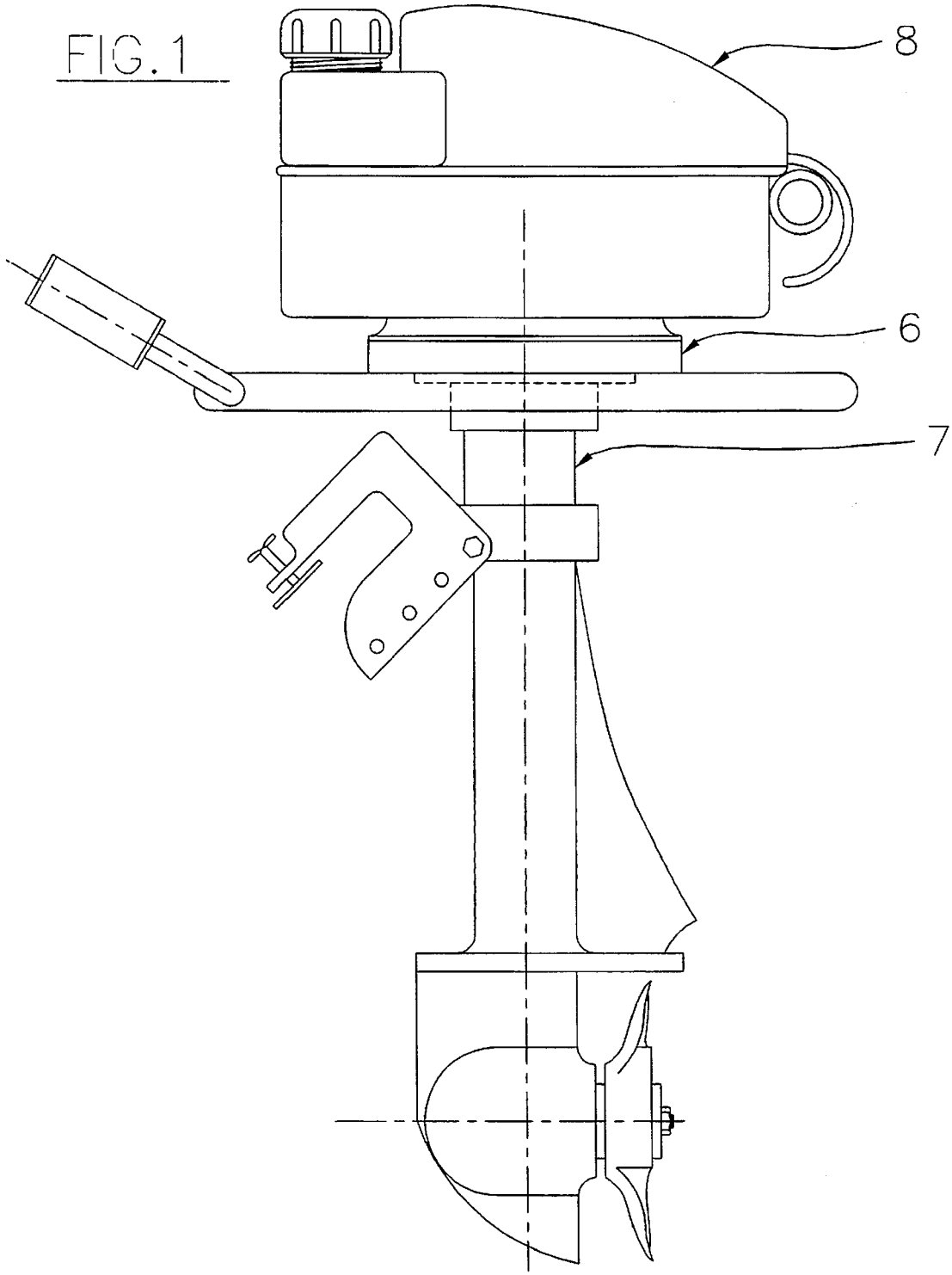
FIG. 1 is a side elevational view illustrating the adapter plate connecting a vertical shaft internal combustion engine to an outboard motor lower unit.
Figure 2:
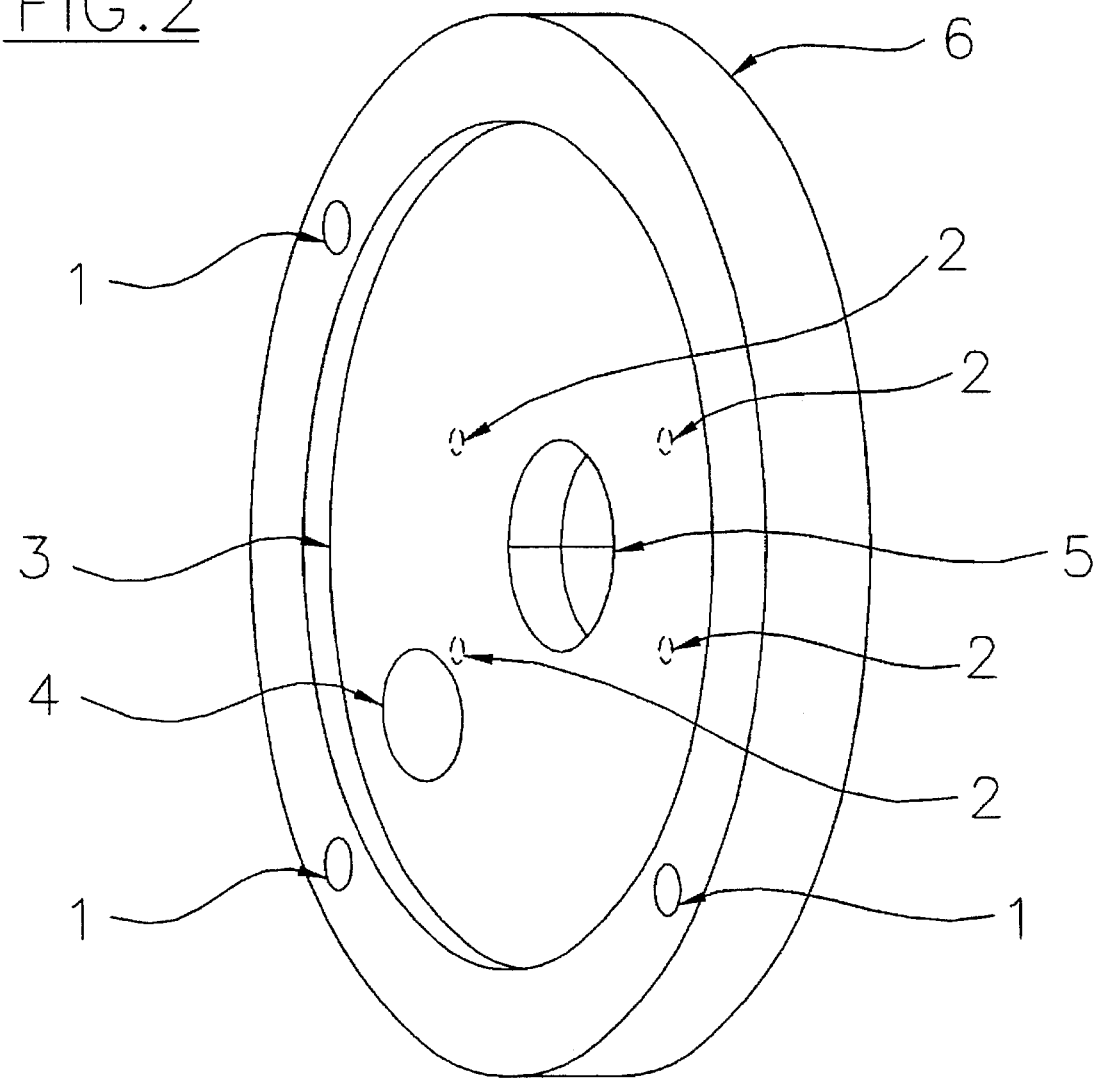
FIG. 2 is a perspective view of the adapter plate.
Figure 4:
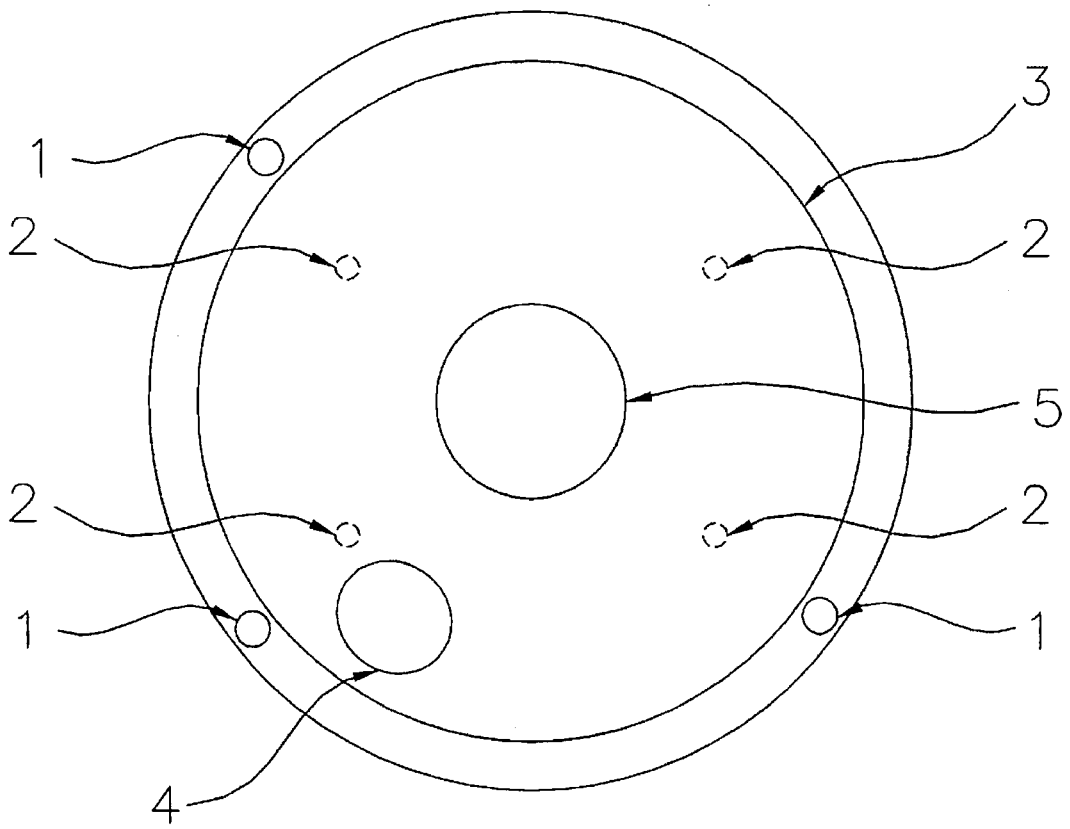
FIG. 4 is a elevation view of the end of the adapter plate.
Figure 3:
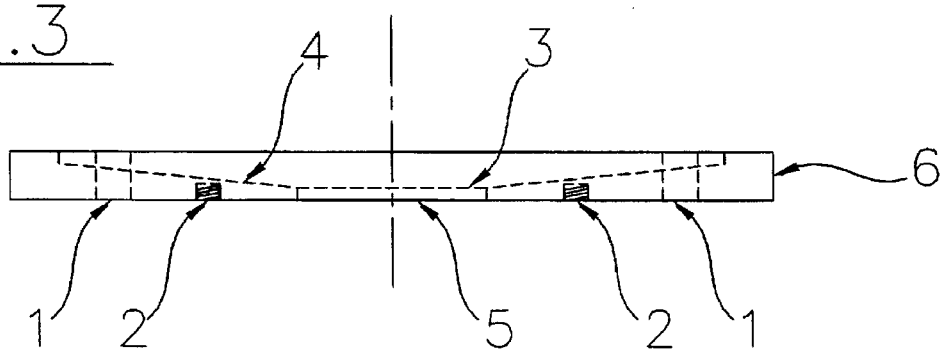
FIG. 3 is a side elevation view of the adapter plate.

In the drawings there is shown an adapter plate unit comprising of a cylindrical body having general parallel end faces. On one end of the body there are holes (1) to facilitate the attaching of the four cycle verticle shaft engine. On the opposite side of the body there are holes (2) to facilitate the attachment of an outboard motor lower unit. On the other end of the adapter body there is a recess (3) to enable the body of the four cycle verticle shaft engine (8) to be attached to the adapter plate and allow a recessed area (3) for the oil pan and oil pump (4). There is a longitudinal opening (5) allowing the crank shaft of the four cycle verticle shaft engine to penetrate through the adapter plate (6) and be attached to the outboard motor lower unit (7). On the opposite face there are holes (2) of various dimensions to allow for the attachment of the outboard motor lower unit (7) to the adapter plate (6). The adapter plate unit is very compact and efficient in design. The adapter plate may be composed of any durable material such as metal (e.g., aluminum, steel, bronze, brass or any type of metal and or various compositions of plastics and expoxy materials) which is capable of giving this adapter the strength that the design requires in order to support the coupling of the two items, a verticle shaft four cycle internal combustion engine (8) and an outboard motor lower drive unit (7).

What is claimed is:

1. An outboard marine drive adapter plate to attach a four cycle vertical sham internal combustion engine to a marine outboard lower drive unit comprising a cylindrical body member having a top and a bottom, the top having a flat circular raised peripheral edge portion and a recessed circular central portion forming a cavity to accommodate an oil pan and an oil pump of a four cycle engine, the bottom being substantially flat and parallel to the top flat circular peripheral edge portion, wherein the flat circular peripheral edge portion includes holes to accommodate the attachment of a four cycle engine, wherein the bottom of the body member in a portion directly below the recessed circular central portion has holes to accommodate the attachment of a marine outboard lower drive unit, wherein the recessed circular central portion includes a hole to accommodate a drive shaft of a four cycle vertical shaft internal combustion engine, the outboard marine drive adapter plate allowing the attachment and use of a four cycle vertical shaft internal combustion engine of various sizes and horsepower ranges to a marine outboard lower drive unit of various sizes and shapes.

* * * * *